United States Patent [19]

Wilson

[11] 3,991,495

[45] Nov. 16, 1976

[54] INFORMATION DEVICE FOR FACILITATING MERCHANDISE INVENTORY CONTROL

[76] Inventor: Bobby G. Wilson, 2404 Avenue H, Rosenberg, Tex. 77471

[22] Filed: Dec. 4, 1974

[21] Appl. No.: 529,280

[52] U.S. Cl. ..... 40/64 R; 40/19.5; 40/125 A

[51] Int. Cl.[2] ..... G09F 11/30

[58] Field of Search ..... 40/64 R, 65, 10 R, 19.5, 40/128

[56] References Cited

UNITED STATES PATENTS

| | | | |
|---|---|---|---|
| 1,017,806 | 2/1912 | Rodgers | 40/65 |
| 1,508,779 | 9/1924 | Dumont | 40/64 R |
| 3,228,131 | 1/1966 | Heck | 40/10 R X |
| 3,477,146 | 11/1969 | Warneke | 40/65 X |

*Primary Examiner*—Louis G. Mancene
*Assistant Examiner*—John H. Wolff
*Attorney, Agent, or Firm*—Bard, Springs & Jackson

[57] ABSTRACT

An inventory information device for facilitating merchandise inventory control in accordance with the present invention comprises a housing defining a chamber therein. Means is provided for retaining the housing in assembly with a merchandise display shelf in order that inventory information provided on the device may be inspected by inventory control personnel. An inventory information element is movably received within the chamber of the housing and is capable of being moved from a retracted position where the element is substantially fully received within the housing, to an extended position, where the element is at least partially extended from the housing and exposing indicia that is present on the inventory information element. A recess is formed in the housing that is aligned with an aperture formed in a portion of the inventory information element in the retracted position of the inventory information element. A stylus, pencil or any other suitably pointed element may be inserted through the recess of the housing into the aperture of the inventory information element and force may be applied through the stylus to impart movement of the inventory information element toward the extended position thereof. Means is also provided to prevent separation of the inventory information element from the housing in the fully extended position thereof.

8 Claims, 9 Drawing Figures

FIG. 1
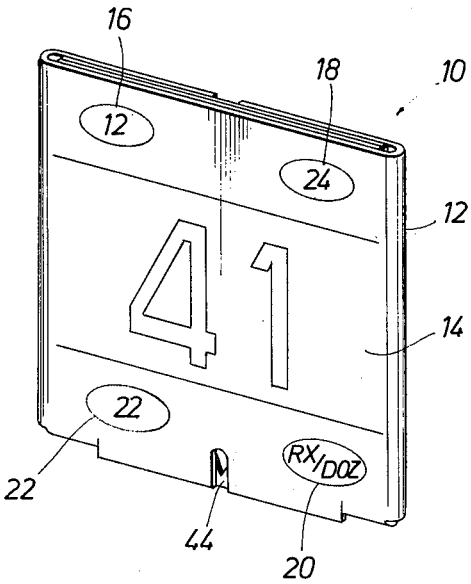
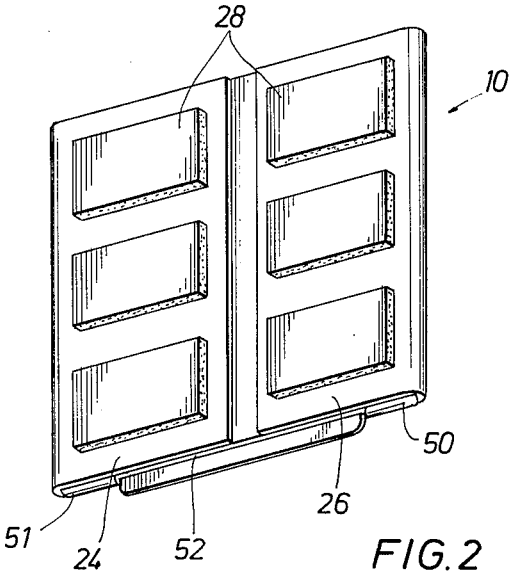
FIG. 2
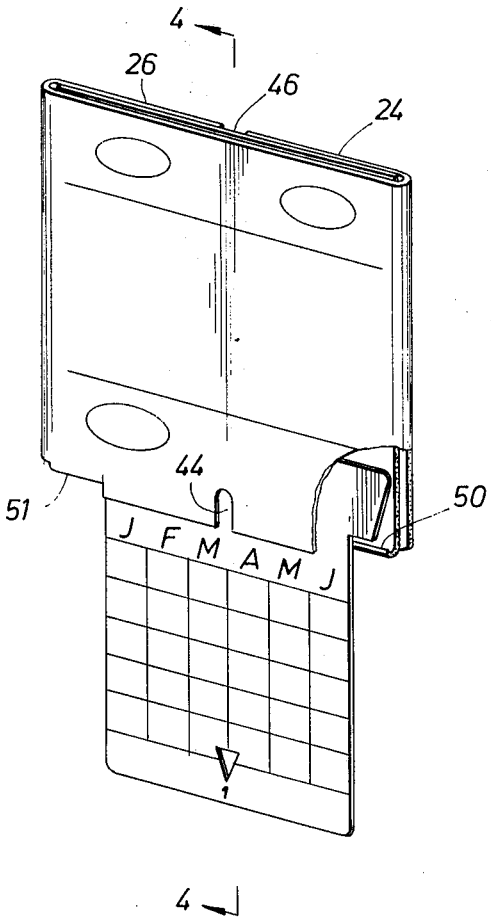
FIG. 3
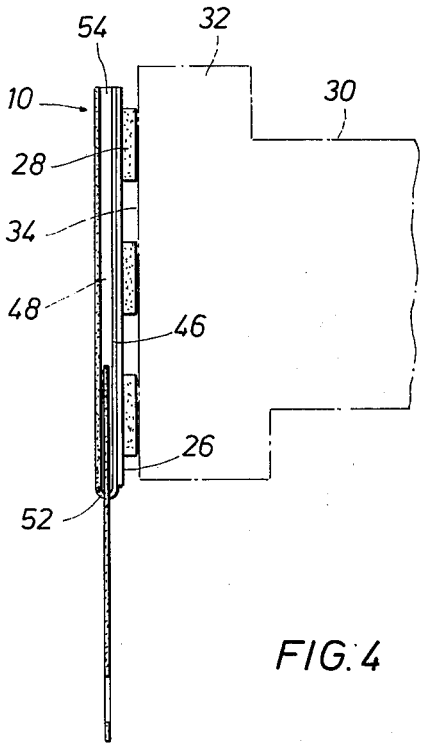
FIG. 4

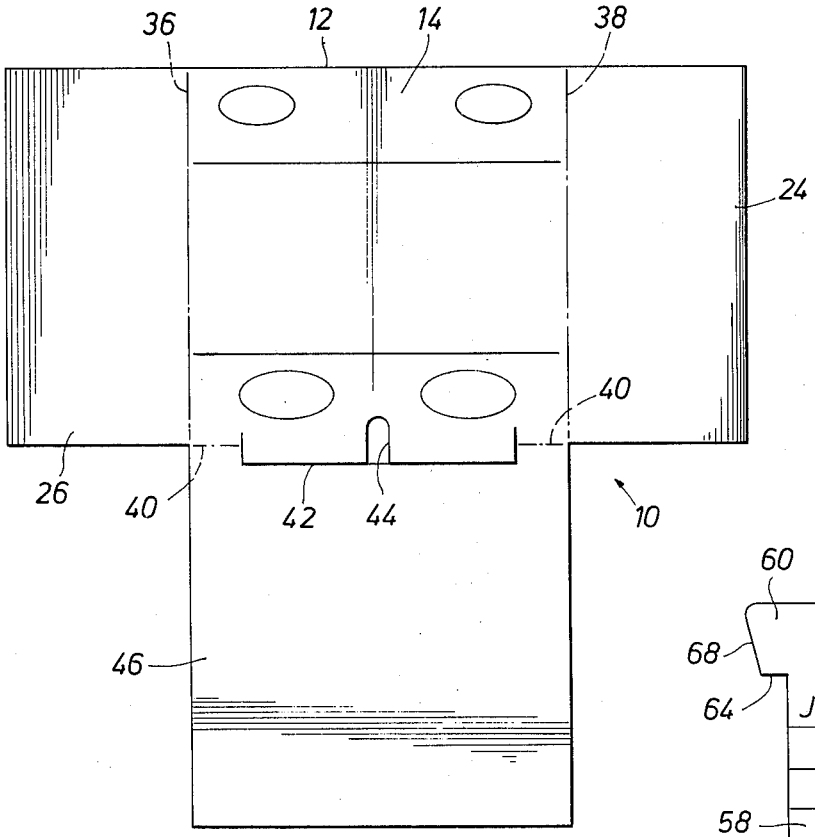
FIG. 5
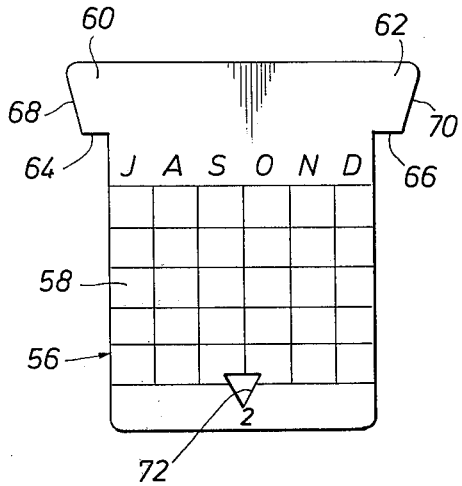
FIG. 6
FIG. 7
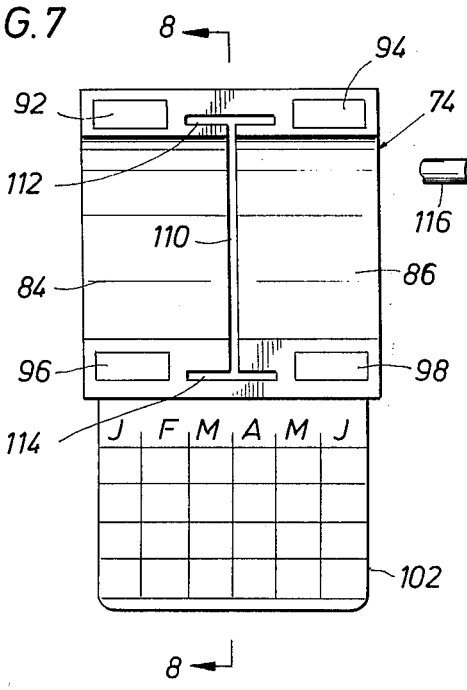
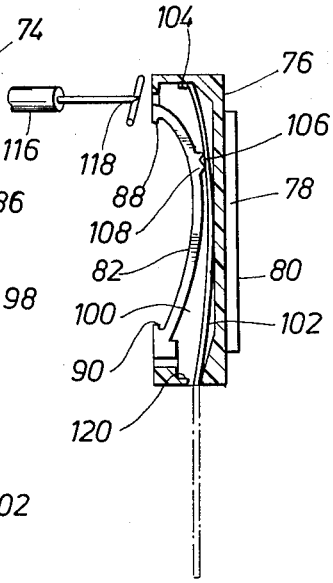
FIG. 8
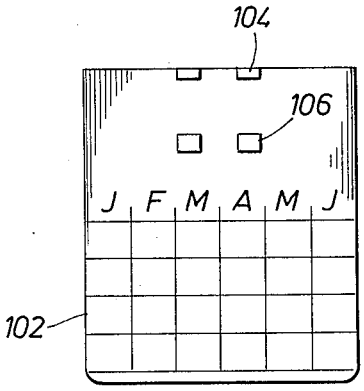
FIG. 9

INFORMATION DEVICE FOR FACILITATING MERCHANDISE INVENTORY CONTROL

FIELD OF THE INVENTION

This invention is related generally to inventory control for merchandising operations and especially to retail merchandising in retail establishments wherein many hundreds or thousands of products are stocked and sold to purchasers. More specifically, the present invention is directed to an inventory information device that is utilized to facilitate simple and efficient as well as accurate and low cost control of the inventory of merchandising establishments.

BACKGROUND OF THE INVENTION

Although the present invention is directed specifically to a device that effectively facilitates simple, efficient and low cost inventory control for retail merchandising establishments, it is not intended to limit the use of the invention to retail merchandising establishments or to merchandising establishments. The invention may well be useable in any circumstances where a large number of different items are stored for the purpose of keeping them readily available for use and wherein a system is employed for maintaining an optimum supply of the parts on hand at all times.

Maintenance of an adequate inventory of goods has long been a problem of vertually all commercial retail establishments such as drug stores, a grocery stores, hardware stores, etc. Before the development of computerized inventory control, it was necessary for inventory control personnel to periodically count each of the various items in inventory and, if the inventory presented a deficiency of some of the items, the inventory control personnel would initiate an order from a supplier who would ship the desired quantity of the goods to the commercial establishment. Although inventory control is typically a relatively simple task, it is extremely critical to the successful operation of a commercial retail establishment and therefore it is typically required that experienced and high paid personnel be employed for the purpose of inventory control. Obviously, utilization of high paid personnel for a task of simple nature detracts from the commerical feasibility of the merchandising operation. The age old method of periodically counting each of the various articles in supply and making a decision whether to by an additional supply of the artiicles or to defer buying until a later date is an extremely time consuming and expensive operation. It is typically so burdensome and expensive a task that some of the larger retail establishments utilize cash register machines that serve as computer information terminals for inventory control purposes. Reorder decisions are made by computers responsive to the information being received from the data terminals established by the cash registers. Computerized inventory control is of course available only for the larger retail establishments because of its prohibitive cost. Because of the human factor in most computerized inventory programs there are still a great number of errors made. The inventory control system of the present invention has several features that would tend to make it additive to, rather than strictly competative with computerized systems. No inventory control system is yet known that may be utilized efficiently in small retail operations such as a single drug store, for example, and yet will facilitate simple, efficient and low cost inventory control utilizing relatively low cost labor to accomplish such inventory control without close supervision.

In small retail establishments, there is typically no efficient way of determining the optimum quantity of goods to order so that an optimum supply of goods may be maintained on hand. It would be ideal for the last of the items on hand to be sold on the same date that a new order of goods is received and placed on the shelf. This of course is utopian and, therefore happens very seldom.

Responsive to an order transmitted by the buyer to a supplier, the supplier will ship a quantity of goods and providee an invoice covering the quantity of goods shipped. There is often no way to determine if there is a shortage of the items shipped, or if some of the items ordered are not shipped at all or if items received were not actually ordered. Suppliers sometimes inadvertently omit an ordered item from an invoice or fail to ship the correct number of items ordered and there is no simple way to determine if errors appear in the shipping invoice or the quantity of items shipped except by direct comparison of the invoice with the order and with the goods actually received before the goods are placed in storage or placed on the retail shelf. The double checking and cross checking necessary to insure that orders and deliveries are correct is very time consuming and expensive and therefore interferes with retail profit. Moreover, double checking and cross checking orders, shipping invoices and products often requires experienced and expensive personnel, thereby further adversely affectiing the profit of the retail operation.

Experienced inventory control personnel are typically employed because of the necessity to maintain a proper quantity of saleable items on hand and to insure that merchandise is not overordered or underordered. Where merchandise is overordered, when a quantity in excess of the maximum allowable inventory is ordered, and the product is a fast selling item, the inventory will soon adjust itself and the retail establishment will not suffer materially by having its inventory funds out of circulation for long periods of time. If an overordered product is very slow to sell, overordering can work to the severe disadvantage of the retail establishment because of the slow turnover of its inventory funds.

Overordering or underordering can result from mistakes on the part of suppliers, which mistakes may go undetected if a simple and efficient method of checking the inventory is not available. It is desirable therefore to provide a simple and efficient inventory procedure for clearly identifying mistakes of suppliers in order that the inventory of the retail establishment will always be maintained at an optimum level.

Typical order book type inventory control systems for small retail establishments typically fail to incorporate any means, other than experience on the part of the inventory control personnel, for quickly and efficiently identifying the suppliers for particular goods that may need reordering to bring the inventory to the desired level. Further, it is typically a time-consuming and expensive task to identify alternate suppliers for much of the merchandise that is sold in order to render the inventory control procedure more efficient.

There is typically a certain amount of "intellectual guess work" involved in making "buy" or "no buy" decisions based on current stock in inventory. The inventory control personnel, in order to make proper buy or no buy decisions must be aware of the volume of sales of each of the goods in order to ascertain the optimum time for reordering. Ordinarily, inventory control personnel should also know the shipping time of products ordered (the time from the date of order to the date of delivery) and the shelf life of each of the products. It is also desirable to be able to ascertain the quantity/price breakdown of each item sold and to known the best source of supply and alternate source of supply for the items to be ordered. It is typically required that personnel capable of accomplishing these tasks and having such knowledge will be of considerable experience and therefore will be able to command a salary that is quite high. The owner or manager of typical merchandising operations will frequently be required to accomplish ordering and checking of stock and inventory control, especially if experienced personnel is not available for such tasks.

Personnel that are utilized for ordering and receiving stock are typically required to double check each order in order to eliminate errors in ordering. It is also necessary for such ordering personnel to cross check deliveries and orders in order to determine if all of the merchandise ordered is delivered, to determine if any of the merchandise ordered is not delivered and to identify mistakes in invoicing. Experienced and high paid personnel are typically required for stock control because of the accuracy that is necessary to insure efficiency of the inventory control system.

It is therefore a primary object of the present invention to provide inventory control apparatus that facilitates low cost inventory control for merchandising operations.

It is also a feature of the present invention to provide novel inventory control apparatus that promotes development of an inventory control system that may be accomplished by relatively inexperienced personnel.

It is also a feature of the present invention to provide novel apparatus for inventory control that effectively eliminates the necessity for checking, double checking and across checking orders and merchandise delivered in order to determine errors in ordering shipping and invoicing.

Among the several features of the present invention is noted the contemplation of novel apparatus for inventory control of merchandising establishments that provides a clear indication of the number of sales per sales period of any of a number of particular items, thereby giving ordering personnel a positive indication of the desired number of units to be ordered and thereby preventing inventory costs from becoming excessive.

Another feature of the present invention includes the provision of novel apparatus for inventory control of merchandising operations wherein shortages of items ordered become clearly obvious when a group of different products ordered are placed on the shelf following receipt of merchandise.

It is another important feature of the present invention to provide novel apparatus for inventory control that provides an effective means for determining which of the many items of a merchandising operation to order and which eliminates the necessity for time consuming counting of merchandise and comparison of merchandise on hand with optimum inventory levels.

It is also a feature of this invention to provide novel apparatus for inventory control wherein suppliers and alternate suppliers for the various products sold by the merchandising operation may be simply and efficiently identified by relatively inexperienced order and inventory handling personnel.

Among the several features of the present invention is noted the contemplation of novel inventory control apparatus that is subject to simple and efficient utilization and effectively reduces the amount of the time necessary for training inventory control personnel.

It is also an important object of the present invention to provide novel inventory control apparatus that effectively facilitates simple and efficient identification of misorders where a supplier has mistakenly shipped a quantity of items that are presently in good supply and effectively preventing accumulation of slow moving inventory.

It is an even further object of the present invention to provide novel apparatus for inventory control that effectively eliminates a majority of the intellectual guess work that is involved in making buy or no buy decisions based on current stock.

Other and further objects, advantages and features of the invention will become obvious to one skilled in the art upon an understanding of the illustrative embodiments about to be described and various advantages, not referred to herein, will occur to one skilled in the art upon employment of the invention in practice.

SUMMARY OF THE INVENTION

The inventory information device of the present invention is a mechanical device that may be attached to a shelf structure on which shelf is supported a quantity of products to be sold. The mechanical device may incorporate a housing that may be supported by the shelf structure in any suitable manner and which housing has a display surface provided thereon on which may be indicated the retail price of the product being sold in addition to other information which is valuable for inventory control. The minimum inventory number or order point may be provided on the display portion of the housing structure and the maximum inventory or order quantity number may also be presented, thereby facilitating mechanical buy or no buy decisions by inventory control personnel, depending upon whether the quantity of product counted is above or below the quantity established for minimum inventory. By using "order point" and "order quantity" the mathematics of subtracting the amount on hand from maximum inventory is eliminated, thus simplifying the procedure even further.

The display portion of the housing structure may also be provided with a name or code for a supplier of that particular product, thereby enabling inventory control personnel to identify the supplier when ordering without having to refer to supplier records. A cost code may also be provided on the display portion of the housing structure to provide inventory control personnel with information related tp optimum quantity/cost breakdown.

The housing may be provided with an interior chamber within which may be disposed an inventory information element that is extendable from the chamber as desired in order that inventory control personnel may enter information that is useful in subsequent inventory analysis. The element retained within the housing may be in the form of a slide having an aperture formed therein, which aperture mates with a slot or recess formed in the housing structure when the slide is fully telescopically received within the housing. A pointed object such as a pencil, stylus or the like may be inserted into the aperture of the slide through the slot or recess in the housing and manual pressure may be applied to extend the slide from the housing. The slide may be printed with blocks identifying the weeks of each month and the months of the year, and quantity of product ordered may be entered at the appropriate week and month identifying section of the slide as an order is made. Subsequently, the slides may be quite easily visually inspected and inventory control personnel will be provided with an immediate indication of the volume of sales for the particular product involved.

The housing structure may be provided with internal stop surfaces that cooperate with stop shoulders formed on the slide structure to prevent the slide from being completely withdrawn from the housing as it is moved linearly with a pencil or stylus. The housing may also be provided with an opening at the opposite extremity, allowing the slide structure to be completely removed from the housing for reversal or replacement as desired.

The housing structure may be provided with means for enabling simple and efficient change of the price of the particular merchandise involved.

BRIEF DESCRIPTION OF THE DRAWINGS

In order that the manner in which the above-recited advantages and objects of the invention are attained, as well as others, which will become apparent, can be understood in detail, more particular description of the invention, briefly summarized above, may be had by reference to the specific embodiments thereof that are illustrated in the appended drawings, which drawings form a part of this specification. It is to be understood, however, that the appended drawings illustrate only typical embodiments of the invention and are therefore not to be considered to be limiting of its scope, for the invention may admit to other equally effective embodiments.

In the Drawings:

FIG. 1 is a pictorial representation in isometric view of the inventory control apparatus of the present invention illustrating particularly the front face of the apparatus.

FIG. 2 is an isometric view illustrating the rear portion of the inventory control apparatus of FIG. 1.

FIG. 3 is an isometric view illustrating the front portion of the inventory control apparatus of FIG. 1 and showing the slide element in its lowermost position, with portions of the housing structure broken away to illustrate the slide stop assembly thereof in detail.

FIG. 4 s a sectional view taken along line 4—4 of FIG. 3 and illustrating assembly of the housing structure to the front portion of a product display shelf.

FIG. 5 is an elevational view of the housing structure of the inventory control device set forth in FIGS. 1–5 and depicting the housing structure in the unfolded condition thereof.

FIG. 6 is an elevational view of the slide element portion of the inventory control apparatus of the present invention.

FIG. 7 is a front view of an inventory control device representing a modified embodiment of the present invention.

FIG. 8 is a sectional view taken along line 8—8 in FIG. 7.

FIG. 9 is an elevational view of the slide element portion of the inventory control apparatus of the present invention.

DETAILED DESCRIPTION OF PREFERRED EMBODIMENTS

Now referring to the drawings and first to FIG. 1 there is shown an inventory control apparatus generally at 10 comprising a housing 12 having a generally rectangular information display face 14 upon which may be displayed information related to a product retained on a display shelf to which the housing structure 12 may be attached. Prominently at the center of the display face 14 may be provided price information identifying the retail price of the merchandise that is contained on the display shelf immediately behind the inventory control device. One or more adhesive backed price numbers may be adhered to the display face 14 to identify the price of the product involved. The price identifying characters may simply be removed and replaced in the event of a price change or another price number element may be adhered to a previously applied price number in paste-over fashion if desired.

The information display face 14 may be printed with information areas to facilitate proper and repetitive location of various coding information that is utilized in conjunction with inventory control of the merchandise container on the display shelf. For example, a small printed elliptical area 16 which, of course, may take any other suitable configuration as desired for aesthetic appearance, may provide a space for manual entry of the number desired for minimum inventory or order point. A similar printed area 18 may be provided on which may be entered a number identifying the maximum inventory level or order quantity for that particular product. Inventory control personnel, upon counting the number of products contained on the shelf, can readily ascertain that inventory on hand is within thee range of the minimum and maximum inventory levels desired. For example, as indicated in FIG. 1, the minimum inventory level for a particular product is 12 while the maximum inventory level is 24. If the number counted by inventory control personnel is below 12, reordering is appropriate and, the number of produts to be ordered may be as much as is required to bring the total number on hand to a maximum of 24.

A printed information aarea 20 may also be provided that may contain cost code information that will indicate the optimum number of products to be ordered so as to take advantage of price reductions for the quantity ordered. For example, 14 items may be required to bring the inventory to its maximum level of 24. If products are sold in case lots of twelve and the better price is obtained by purchasing products in case lots, a single case would be ordered even though a single case would not bring the inventory up to its maximum. Inventory control personnel, however, would not be required to understand the full meaning of the cost code entered in information area 20, but would simply follow the rule and order the particular quantity that is determined by the cost code utilizing the order point and order quantity concept greatly simplifies the ordering procedure.

Another information area 22 may be provided upon which may be presented information relating to the particular manufacturer or supplier from which the product may be obtained and which may also include information relating to alternate sources of supply for the particular product.

As illustrated in FIG. 1, the rear flaps 24 and 26 defining a major portion of the rear surface area of the housing structure may be provided with one or more housing retention devices such as shown at 28 to enable the housing to be removably secured to a support surface of a shelf. If desired, the retention device 28 may conveniently take the form of elements having an adhesive material on at least one side thereof enabling the retention devices to stick to a supporting surface of a shelf. The adhesive sided retention devices may conveniently take the form of material that is affixed to the rear flaps 24 and 26 of the housing structure in any suitable manner. The exposed face of the retention devices may be coated with an adhesive material and may have a removable covering provided thereon to protect the adhesive material from contamination prior to application of the inventory control device to the shelf structure. The protective covering may be peeled away immediately prior to adherence of the inventory control device to the front portion of the display shelf in the manner illustrated in FIG. 4. To receive the inventory control device, a display shelf, shown in broken line at 30, may be provided with a front element 32 having a display face 34 to which the adhesive portion of the retention devices 28 may become adhered.

Referring now to FIG. 5 the housing structure 12 of the inventory control device 10 may be formed from a single sheet of material such as paper, metal, plastic, etc. The sheet of material may be provided in the configuration illustrated in FIG. 5 and may be ruled or perforated along broken lines 36, 38 and 40. Additionally, the sheet may be cut along the solid line 42 and an opening 44 may be punched out of the sheet during the ruling, perforation or cutting operations that develop the sheet configuration illustrated in FIG. 5. Ruled or perforated lines 36 and 38 define a fold line, allowing the flaps 24 and 26 to be folded to the position illustrated in FIGS. 1 and 3. Likewise, the ruled or perforated line 40 defines a fold line allowing a rear flap 46 to be folded to the position illustrated in FIG. 4. The housing structure 12 may be assembled by first folding the rear flap 46 along line 40 to the position illustrated in FIGS. 1, 3 and 4 where it is disposed in juxtaposed relation with the front wall defining the information display surface 14 of the housing. It may be desirable to place a relatively rigid flat element against the rear surface of the wall defining the information display surface 14, thereby causing the rear flat 46 to become properly oriented relative to the front wall structure to develop a generally rectangular chamber 48 as shown in FIG. 2 to receive an information slide element. After the flap 46 has been folded to the position illustrated in FIG. 4, a quantity of adhesive material may be applied to the outer surface of the flap 46 or may be applied to the side flaps 24 and 26, or both and the side flaps may be folded along lines 36 and 38 respectively to the position illustrated in FIGS. 1, 3 and 4. The adhesive material, upon curving, will secure the flaps in position and retain the housing in assembly.

With the rear wall flap folded along line 40 to the position illustrated in FIGS. 1, 3 and 4, the folded portions 50 and 51 on either side of the cut line 42 will define internal stop surfaces on either side of the housing structure. As the rear wall flap 46 is folded, an elongated opening or aperture 52 will be defined that is centrally located with respect to the stop surfaces 50. The internal chamber 48 defined by the housing structure will have an elongated upper opening 54 which extends the entire width of the housing.

With reference now to FIGS. 3 and 6, an inventory information element may be provided as shown generally at 56 which may be composed of any suitable sheet material such as paper, plastic, metal, etc. and which may be received within the chamber 48 of the housing. The inventory information element 56 may have a generally rectangular body portion 58 of slightly less width than the width of the lower opening 52 of the housing structure.

The body portion may be printed with indicia of any suitable character to provide inventory information that is desired. For example, as shown in FIG. 6 the body portion 58 may be printed with rectangular blocks identifying weeks and months of the year. Both sides of the body 58 may be so printed thereby allowing the inventory information device to be reversed within the chamber 48 of the housing to correspond to the particular month and week of the year that inventory activity is taking place. As shown in FIGS. 3 and 6 the letters J, F, M, A, and J of FIG. 3 represent the first 6 month period of the year while the letters J, A, S, O, N, and D shown in FIG. 6 represent the second 6 month period. The vertical columns of rectangular spaces are provided for entry inventory information corresponding to the particular week of the month where inventory activity is taking place.

The inventory information element 56 may be removed from the housing structure at the end of a particular year and may be stored in order that the inventory information provided thereon may be utilized for purposes of controlling future inventory activity. It is logical that the inventory information contained on the element 56 may at the end of a year of inventory activity be placed in computer storage and utilized through computer operations for scheduling and controlling of future inventory activity. In this manner, inventory information and control including purchasing manufacturer and supplier information and a wealth of other useful information may be obtained and recorded in simple and convenient manner for future use in connection with inventory control. In this manner, commercial retail establishments may effectively streamline inventory operations very simply and at low cost in order to promote better efficiency of commercial operations.

As shown in FIG. 6, the upper portion of the inventory information element 56 is formed to define lateral extension portions 60 and 62 each defining stop shoulders 64 and 66 respectively and defining tapered and rounded guiding and friction reduction surfaces 68 and 70. The width of the upper portion of the inventory information element defined by the extension portions 60 and 62 is slightly less than the width of the opening 54 of the chamber 48, thereby allowing the entire information slide element to be received within the chamber 48. The tapered guide surfaces 68 and 70 are provided to guide the upper portion of the element or slide 56 into the chamber 48 and to reduce friction of the slide element against the chamber element facilitating smooth operation of the slide element.

The information slide element will be movably received within the chamber 48 but will have sufficient closeness of fit within the chamber retard the information slide element against free movement. It will therefore be necessary to physically impart movement to the information slide element, but such movement will occur quite readily upon manual manipulation of the slide. The stop shoulders 64 and 66 of the information slide element will engage the stop surfaces defined by the bent portions 50 and 51 of the housing structure that are defined upon bending the sheet material along the broken line 40. Moreover, the bent portions 50 and 51 of the sheet material are spaced apart and define a lower central opening that is slightly wider than the width of the lower portion of the information slide element 56, thereby allowing the lower portion of the slide element to be moved downwardly through the opening as desired for exposure of the inventory information provided thereon.

The cut out or stamped out opening 44 in the sheet material from which the housing is composed defines a slot 44 when the sheet material is folded in the manner shown in FIGS. 1 and 3. The slot 44 is disposed in registry with a centrally located aperture 72 that is formed in the lower portion of the information slide element 56. The aperture 72 may be of triangular configuration as illustrated in FIG. 6 or it may take any other convenient device as is deemed desirable. For manipulation of the information slide element, an instrument such as a stylus or pencil having a small diameter projection may be inserted through the slot 44 and through the aperture 72 and a downward force may be applied to the stylus or pencil on the information slide element thereby causing the information slide element to move downwardly as far as is desired for display of the information contained thereon. Downward movement of the information slide element will be limited by contact between the stop shoulder 64 and 66 of the slide element and the stop surfaces provided by the folded portions 50 and 51 of the housing structure.

Inventory personnel involved in stocking inventory will first look at the order point or minimum inventory numbers that will be entered in the information areas 16 of the housing structure. The inventory contained on the product display shelves will be counted and if the number of products is at or below the minimum inventory or order point level shown in block 16, the inventory personnel will be immediately aware that ordering is necessary. A stylus or pencil will be inserted through the slot 44 into the aperture 72 and the information slide element will be moved downwardly to its full extent and the order quantity shown in block 18 may be entered in the proper month and week on the inventory information element. The slide element will be allowed to remain in this downward position until the order is received and the shelf is restocked.

At the time the shelf is restocked, the inventory personnel will place the products on the shelf and will count the number of products that are present on the shelf. If the number of products exceeds the maximum number set forth in information area 18 of the housing structure, an indication will be given that an excessive number of products have been shipped, thereby indicating a supplier's error in shipping. If this occurs, the shipping invoice may be checked for the purpose of verifying any error that might have occurred and the supplier may be notified of such error. After all of the products that have been received have been placed on the shelves, following the procedure indicated above, any of the inventory information slides that remain in the downward position will provide an indication that those particular products which were ordered were not in fact shipped. The invoice may be again checked to insure that the merchandiser is not invoiced for products that were not in fact shipped. The inventory information system of the present invention effectively provides a means for simple and efficient varification of any errors that might have occurred in ordering or shipment of the products. This will prevent the shelves of the merchandiser from becoming overstocked with slow moving products and will provide means for quickly verifying and correcting any errors that might have occurred.

Referring now to FIGS. 7 and 8, a modified embodiment of the present invention is illustrated incorporating a housing structure illustrated generally at 74 that may be composed of plastic, metal or any other suitable material and which may be of generally rectangular configuration defining a substantially flat rear wall 76. A body 78 may be secured to the rear surface 76 of the housing structure in any suitable manner and may provide a surface 80 that may be adhered to a shelf structure in similar manner as set forth in FIG. 4 of this application. The body 78, if desired, may have two adhesive surfaces, one of which may be received by the flat rear wall of the housing while the other is provided for adhering the inventory control mechanism to the front face of the shelf structure.

The housing structure may have a concave surface 82 defining a recess within which may be received relatively thin and flexible price information elements such as shown at 84 and 86 in FIG. 7, which price information elements may be retained by upper and lower lips 88 and 90, respectively, formed on the housing structure. A pair of upper information elements 92 and 94 may be provided on the housing structure, within which may be written or otherwise provided order point and order quantity inventory information to allow ordering personnel to maintain an optimum quantity of products on the shelf at all times to facilitate efficient inventory control. Information elements 96 and 98 may be provided at the lower portion of the housing structure to provide supplier information and price/quantity information that will enabling ordering personnel to easiliy and efficiently order products from proper suppliers and in proper quantity for efficient inventory control.

Within the housing 74 may be defined a chamber 100 that may be receive a thin and flexible inventory information element or slide 102 that may be moved from the full line position illustrated in FIG. 8 to the downwardly extended broken line position, which downwardly extended position is illustrated in full line in FIG. 7. The inventory information element may be composed of plastic or any other suitable flexible material and may be provided with upper and intermediate spaced pairs of projections 104 and 106 that facilitate movement of the information slide elemenet during ordering and stocking of products. Interiorly of the housing structure may be defined a tapered projection 108 that cooperates with the tapered lower pairs of projections 106 to retain the information slide element 102 in its uppermost or retracted position as illustrated in FIG. 8. The corresponding tapered surface of the projections 106 and 108 function retain the slide element against inadvertent movement, but provide a cam like function to allow the information slide element to move downwardly relative to the projection when sufficient force is applied thereto.

The housing structure may be provided with a slot in the front wall thereof having an elongated intermediate portion 110 and upper and lower transverse portions 112 and 114 respectively. A stylus 116 having a T-shaped manipulator portion 118 may be inserted through the upper portion 112 of the slot and may be brought into engagement with the spaced projections 106. Downward pressure may be applied by the stylist on the projections 106, thereby causing the projections 106 to be moved past the corresponding housing projection 108, thereby causing the slide element 102 to be moved downwardly toward the position illustrated in FIG. 7. The flat portion of the inventory information element may be printed to contain blocks for entry of inventory information in the proper month and week where ordering and/or delivery occurs, thereby providing inventory information that may be effectively utilized for inventory research. The inventory information elements may be removed from the housing and replaced with clean inventory information elements at the end of a particular period of time, such as 6 months or 1 year, and may provide permanent inventory records that may be simply and efficiently used for study to improve merchandising. By printing inventory information on adhesive (removable) tags, the inventory information can be transferred to a permanent record easily and avoid replacing entire slide assemblies.

A stop shoulder 120 is defined within the housing structure and will be contacted by the projections 106 at the lowermost position of the inventory information element 102, thereby preventing the inventory information element from becoming completely separated from the housing inadvertently. The material from which the housing is composed and/or the material from which the inventory information element is composed may be sufficiently yieldable or flexible to allow the information element to be inserted into or completely removed from the housing as desired.

When it is desired to move the inventory information element from the extended position illustrated in FIG. 7 to the retracted position illustrated in FIG. 8, the T-shaped head portion 118 of the stylus 116 may be inserted through the lower transverse portion 114 of the slot in the front wall of the housing and may be moved upwardly through the vertical portion 110 of the slot to the upper transverse portion 112. The T-shaped head portion 118 of the stylus will engage the upper spaced projections 104 on the inventory information element and will allow an upper force to be applied to the information element or slide 102, thereby moving it upwardly to the retracted position thereof. It is apparent that the inventory slide may be manipulated quite readily through utilization of an instrument such as the stylus 116. This feature will prevent customers or other unauthorized personnel from moving the slide elements, thereby confusing the inventory control system.

The inventory information system, including the housing structure and the information slide element illustrated in FIGS. 7, 8 and 9, will be utilized in similar manner as the structure set forth in FIGS. 1–6. Although particular inventory control mechanisms are illustrated in the drawings and described in the specification hereof, it is nevertheless to be borne in mind that other inventory information mechanisms may be provided in accordance with the spirit and scope of the present invention. It is not intended to in any way limit the present invention to the particular embodiments illustrated in the drawings and described in this specification.

In view of the foregoing it is quite clear that the present invention provides a novel inventory control mechanism that provides an effective means for efficient ordering, checking, stocking and verification of inventory and thereby facilitates efficient inventory control of merchandising operations. It is apparent that the present invention is one well adapted to attain all of the objects hereinabove set forth together with other advantages which will become obvious and inherent from the description of the apparatus itself. It will be understood that certain combinations and subcombinations are of utility and may be employed without reference to other features and subcombinations. As many possible embodiments may be made of this invention without departing from the spirit or scope thereof, it is to be understood that all matters herein set forth or shown in the accompanying drawings are to be interpreted as illustrative and not in a limiting sense.

What is claimed is:

1. An inventory information device for facilitating merchandise inventory control to maintain an optimum supply of merchandise for efficient operation of merchandising establishments, said inventory information device comprising:

a housing having a chamber formed therein and being formed to define opposed first and second openings to said chamber, said first opening being larger than said second opening, said housing definding stop elements on either side of said second opening, said housing defining a display surface means and rear surface means;

retention means being fixed to said rear surface means for retaining said housing in assembly with the front portion of a merchandise display shelf of a merchandising establishment;

an inventory information element being received in movable relation within said chamber of said housing and being linearly movable from a retracted position, where said element is substantially fully received within said chamber of said housing, to an extended position, where said inventory information element is moved at least partially through said second opening and is at least partially extended from said housing exposing indicia present on said element, said inventory information element having a body portion of smaller dimensions than the dimension of said second opening allowing said body portion to pass through said second opening and having extension portions on opposed portions of said body and cooperating with said body portion to define a stop portion of larger dimension than the dimension of said second opening and of smaller dimension than the dimension of said first opening, said stop portion being receivable within said first opening and defining opposed stop shoulders disposed for engagement with said stop elements in the fully extended position of said inventory information element;

an information element access opening is defined by said housing;

a portion of said inventory information element is exposed by said information element access opening in the retracted position of said information element; and an aperture being formed in said exposed portion of said inventory information element, said aperture being adapted to receive a movement implement for moving said inventory information element to said extended position relative to said housing.

2. An inventory control device as recited in claim 1, wherein:

a single folded sheet of material defines said housing, said sheet of material being of generally T-shaped configuration defining a central portion and having rear flap portions extending from two opposed sides of said centraal portion, said sheet of material having a rear wall flap extending from a third side of said central portion, said rear flap portion and said rear wall portions being joined to said central portion at fold lines defined along edge portions of said central wall portion said rear wall flap being secured to said rear flap portions.

3. An inventory control device as recited in claim 1, wherein:

said housing is molded from a moldable material.

4. An inventory control device as recited in claim 1, wherein:

an elongated opening is formed in said housing;

said elongated opening being communicated with said chamber;

projection means is formed on said inventory information element, said projection means being engaged for movement of said inventory information element relative to said housing; and manipulating means for inserting through said elongated opening for manipulating engagement with said projection means of said inventory information element.

5. An inventory control device as recited in claim 1, wherein:

said housing retains said inventory information element in the retracted position thereof by frictional contact between said inventory information element and said housing.

6. An inventory control device as recited in claim 1, wherein:

locking means is provided on said housing means and extends into said chamber; and lock engaging means is formed on said inventory information element and engages said locking means in the retracted position of said inventory information element for retention of said inventory information element within said chamber.

7. An inventory information device for facilitating merchandising inventory control to maintain an optimum supply of merchandise for efficient operation of merchandising establishments, said inventory information device comprising:

housing means being formed to define an internal chamber and opposed first and second openings to said chamber, said first opening being larger than said second opening, said housing defining internal stop surfaces on either side of said second opening;

retainer means on said housing means for retaining said housing in assembly with a merchandise display shelf of a merchandising establishment;

an inventory information element being received in movable relation within said chamber of said housing means and being movable between a retracted position relative to said housing means, where at least a portion of said inventory information element is positioned within said housing means and an extended position, where said inventory information element is at least partially extended from said housing means through said second opening means exposing indicia present on said inventory information element, said inventory information element having a body sized to pass through said second opening and having opposed stop shoulders capable of passing only through said first opening, said stop shoulders engaging said internal stop surfaces in the extended position of said inventory information element to limit further extension movement;

an information element access opening is defined by said housing;

a portion of said inventory information element is exposed by said information element access opening in the retracted position of said information element; and an extension aperture is formed in said exposed portion of said information element, said extension aperture being adapted to receive a movement implement to allow an extension force manually applied through the movement implement to impart movement to said inventory information element to said extended position relative to said housing means.

8. An inventory control as recited in claim 7, wherein:

a single folded sheet of material defines said housing, said sheet of material being of generally T-shaped configuration defining a central portion having rear flap portions extending from two sides thereof and having a rear wall flap extending from a third side thereof, said rear flap and rear wall portions being joined to said central portion at fold line defined along edge portions of said central portions, said sheet material being folded along said fold lines, said rear wall flap being secured to said rear flaps.

* * * * *